US008221059B2

(12) United States Patent
Brown

(10) Patent No.: US 8,221,059 B2
(45) Date of Patent: Jul. 17, 2012

(54) VARIABLE GEOMETRY TURBINE

(75) Inventor: David Henry Brown, West Yorkshire (GB)

(73) Assignee: Cummins Turbo Technologies Limited, Huddersfield (GB)

( * ) Notice: Subject to any disclaimer, the term of this patent is extended or adjusted under 35 U.S.C. 154(b) by 0 days.

(21) Appl. No.: 12/891,356

(22) Filed: Sep. 27, 2010

(65) Prior Publication Data

US 2011/0076139 A1 Mar. 31, 2011

Related U.S. Application Data

(63) Continuation of application No. PCT/GB2009/000799, filed on Mar. 26, 2009.

(30) Foreign Application Priority Data

Mar. 27, 2008 (GB) ..... 0805519.6

(51) Int. Cl.
*F03B 1/04* (2006.01)

(52) U.S. Cl. ..... 415/158; 415/157; 415/159; 415/160

(58) Field of Classification Search ..... 415/80, 415/82, 146, 147, 151, 157, 158, 159, 160, 415/186, 191, 208.1, 208.2, 208.3, 208.5, 415/211.1; 416/140, 235, 236 R
See application file for complete search history.

(56) References Cited

U.S. PATENT DOCUMENTS 4,984,965 A * 1/1991 McKean ..... 415/155
5,868,552 A * 2/1999 McKean et al. ..... 415/158
6,652,224 B2 * 11/2003 Mulloy et al. ..... 415/158
6,931,849 B2 * 8/2005 Parker ..... 60/602
6,932,565 B2 * 8/2005 Garrett et al. ..... 415/119
7,097,432 B1 * 8/2006 Lombard et al. ..... 417/295

(Continued)

FOREIGN PATENT DOCUMENTS

JP 05133238 A 5/1993

(Continued)

OTHER PUBLICATIONS

International Search Report, PCT/GB2009/000799, Jul. 10, 2009, Cummins Turbo Technologies Limited.

(Continued)

*Primary Examiner* — Edward Look
*Assistant Examiner* — Aaron R Eastman
(74) *Attorney, Agent, or Firm* — Krieg DeVault LLP; Matthew D. Fair

(57) ABSTRACT

A variable geometry turbine comprises a turbine wheel (5) supported in a housing (1) for rotation about a turbine axis. An annular inlet passage (9) is defined between first and second radial inlet surfaces, one of said first and second inlet surfaces being defined by a moveable wall member (40). A substantially annular array of vanes (41) is provided which extend across the inlet passageway (9); each vane (41) being fixed to said first inlet surface. Each vane (41) has first and second major vane surfaces (45, 46) having a chordal length extending between a radially outer leading vane edge (47) and a radially inner trailing vane edge (48), the first major vane surface (45) facing generally away from the axis and the second major vane surface (46) facing generally towards the axis. A rib (43) extends across at least a substantial portion of the chordal length of at least one of the first and second major vane surfaces (45, 46) of one or more vanes (41) of the array.

16 Claims, 6 Drawing Sheets

U.S. PATENT DOCUMENTS

| | | | | |
|---|---|---|---|---|
| 7,108,481 | B2 * | 9/2006 | Mulloy et al. | 415/158 |
| 7,475,540 | B2 * | 1/2009 | Parker | 60/602 |
| 2003/0190231 | A1 * | 10/2003 | Mulloy et al. | 415/158 |
| 2004/0101402 | A1 * | 5/2004 | Garrett et al. | 415/160 |
| 2004/0128997 | A1 * | 7/2004 | Parker | 60/602 |
| 2009/0097969 | A1 * | 4/2009 | Spuler | 415/159 |
| 2009/0142186 | A1 * | 6/2009 | Parker | 415/159 |

FOREIGN PATENT DOCUMENTS

| | | | |
|---|---|---|---|
| JP | 05214949 | A | 8/1993 |
| WO | WO 02/06636 | | 1/2002 |
| WO | WO 2005/106212 | | 11/2005 |

OTHER PUBLICATIONS

United Kingdom Search Report GB0805519.6, Cummins Turbo Technologies Limied, Jul. 22, 2008.

* cited by examiner

VARIABLE GEOMETRY TURBINE

CROSS REFERENCE TO RELATED APPLICATIONS

The present application is a continuation of PCT/GB2009/000799 filed Mar. 26, 2009, which claims priority to United Kingdom Patent Application No. GB 0805519.6 filed Mar. 27, 2008, each of which is incorporated herein by reference.

The present invention relates to a variable geometry turbine. Particularly, but not exclusively, the present invention relates to variable geometry turbochargers.

Turbochargers are well known devices for supplying air to the intake of an internal combustion engine at pressures above atmospheric pressure (boost pressures). A conventional turbocharger essentially comprises an exhaust gas driven turbine wheel mounted on a rotatable shaft within a turbine housing connected downstream of an engine outlet manifold. Rotation of the turbine wheel rotates a compressor wheel mounted on the other end of the shaft within a compressor housing. The compressor wheel delivers compressed air to the engine intake manifold. The turbocharger shaft is conventionally supported by journal and thrust bearings, including appropriate lubricating systems, located within a central bearing housing connected between the turbine and compressor wheel housings.

In turbochargers, the turbine stage comprises a turbine chamber within which the turbine wheel is mounted; an annular inlet passageway defined between facing radial walls arranged around the turbine chamber; an inlet arranged around the inlet passageway; and an outlet passageway extending from the turbine chamber. The passageways and chambers communicate such that pressurised exhaust gas admitted to the inlet chamber flows through the inlet passageway to the outlet passageway via the turbine and rotates the turbine wheel. Turbine performance can be improved by providing vanes, referred to as nozzle vanes, in the inlet passageway so as to deflect gas flowing through the inlet passageway towards the direction of rotation of the turbine wheel.

Turbines may be of a fixed or variable geometry type. Variable geometry turbines differ from fixed geometry turbines in that the size of the inlet passageway can be varied to optimise gas flow velocities over a range of mass flow rates so that the power output of the turbine can be varied to suite varying engine demands. For instance, when the volume of exhaust gas being delivered to the turbine is relatively low, the velocity of the gas reaching the turbine wheel is maintained at a level which ensures efficient turbine operation by reducing the size of the annular inlet passageway. Turbochargers provided with a variable geometry turbine are referred to as variable geometry turbochargers.

In one type of variable geometry turbine, an axially moveable wall member, generally referred to as a "nozzle ring", defines one wall of the inlet passageway. The position of the nozzle ring relative to a facing wall of the inlet passageway is adjustable to control the axial width of the inlet passageway. Thus, for example, as gas flow through the turbine decreases, the inlet passageway width may be decreased to maintain gas velocity and optimise turbine output. This arrangement differs from another type of variable geometry turbine in which a variable guide vane array comprises adjustable swing guide vanes arranged to pivot so as to open and close the inlet passageway.

The nozzle ring may be provided with vanes which extend into the inlet and through vane slots provided in a "shroud" defining the facing wall of the inlet passageway to accommodate movement of the nozzle ring. Alternatively vanes may extend from the fixed facing wall and through vane slots provided in the nozzle ring. Vane passages are defined between adjacent vanes.

Typically the nozzle ring may comprise a radially extending wall (defining one wall of the inlet passageway) and radially inner and outer axially extending walls or flanges which extend into an annular cavity behind the radial face of the nozzle ring. The cavity is formed in a part of the turbocharger housing (usually either the turbine housing or the turbocharger bearing housing) and accommodates axial movement of the nozzle ring. The flanges may be sealed with respect to the cavity walls to reduce or prevent leakage flow around the back of the nozzle ring. In one known arrangement the nozzle ring is supported on rods extending parallel to the axis of rotation of the turbine wheel and is moved by an actuator which axially displaces the rods.

Nozzle ring actuators can take a variety of forms, including pneumatic, hydraulic and electric and can be linked to the nozzle ring in a variety of ways. The actuator will generally adjust the position of the nozzle ring under the control of an engine control unit (ECU) in order to modify the airflow through the turbine to meet performance requirements.

As mentioned above, as the nozzle ring is moved to adjust the axial width of the inlet passageway, the guide vanes may extend into vane slots to accommodate the movement. There is a gas flow leakage path though the vane slots via which some of the exhaust gas flow through the turbine can bypass at least a portion of the vane passages. As the width of the inlet passageway is reduced towards a minimum, the leakage path through the vane slots can become a significant proportion of the inlet throat area so that leakage flow through the slots can result in a significant reduction in turbine efficiency. It is an object of the present invention to obviate or mitigate this effect.

A variable geometry turbine comprising:

- a turbine wheel supported in a housing for rotation about a turbine axis;
- an annular inlet passage defined between first and second radial inlet surfaces, one of said first and second inlet surfaces being defined by a moveable wall member and the other of said first and second inlet surfaces being defined by a facing wall of said housing, the moveable wall member being moveable relative to the facing wall of the housing along the turbine axis to vary the size of the inlet passageway;
- a substantially annular array of vanes extending across the inlet passageway; each vane being fixed to said first inlet surface, the second inlet surface being provided with respective vane slots for receiving each vane to accommodate relative movement between the first and second surfaces;
- wherein each vane has first and second major vane surfaces having a chordal length extending between a radially outer leading vane edge and a radially inner trailing vane edge, the first major vane surface facing generally away from the axis and the second major vane surface facing generally towards the axis, such that vane passages are defined between the first major surface of each vane and the second major surface of an adjacent vane in the array; and
- wherein a rib extends across at least a substantial portion of the chordal length of at least one of the first and second major vane surfaces of one or more vanes of the array.

The rib preferably extends parallel to, and is spaced from, said first inlet surface. The rib preferably extends parallel to the second inlet surface.

In some embodiments a clearance gap is defined between said at least one major vane surface and a respective vane slot when the vane extends through said slot, the clearance gap having a width defined between the vane surface and an edge of the slot, the rib defining an elongate surface facing the second inlet surface and extending to a height above said at least one major vane surface, said height being greater than the width of the clearance gap.

The surface of the rib may lie in a plane parallel to a plane containing said second surface.

In some embodiments the rib circumscribes the vane and so extends across both the first and second major surfaces. A recess may be provided in the surface of the rib in the region of the leading and/or trailing edge of the vane so that said surface is discontinuous at the leading and/or trailing edge of the vane. Alternatively a gap may be provided in said rib in the region of the leading and/or trailing vane edge so that the rib (and not just the rib surface) is discontinuous at the leading and/or trailing edge of the vane. As a further alternative a recess can be provided in the rib surface at one of the leading or trailing edges and a gap provided in the rib at the other of the leading or trailing edges.

The or each recess or gap may extend around the trailing and/or leading edge of the vane respectively, from the first to the second major vane surface.

In some embodiments an elongate channel is formed in said surface of the rib extending between said upstream and downstream vane edges across the first and/or second major vane surface. The channel may thus run along the respective vane surface and substantially parallel thereto. For instance the channel may be defined in part by a portion of the respective major surface of the vane. For example the channel may have one elongate side defined by said portion of the major surface of the vane and another elongate side defined by the rib. The channel may have a substantially rectilinear cross section or could for instance have a generally "U" shaped, "V" shaped or "C" shaped cross section. In some embodiments the rib and channel may completely circumscribe the vane.

The rib may be spaced from the first surface and have a width (or maximum width) in a direction parallel to the turbine axis which is less than its axial spacing (or minimum axial spacing) from the first surface. The width (or maximum width) of the rib may be greater than the height (or maximum height) to which the rib extends above the or each major vane surface.

In some embodiments the vanes may extend from the moveable wall member through slots provided in the opposing wall of the housing.

Other features of preferred embodiments of the present invention will be apparent from the description below.

Specific embodiments of the present invention will now be described, by way of example only, with reference to the accompany drawings, in which.

Figure 1:
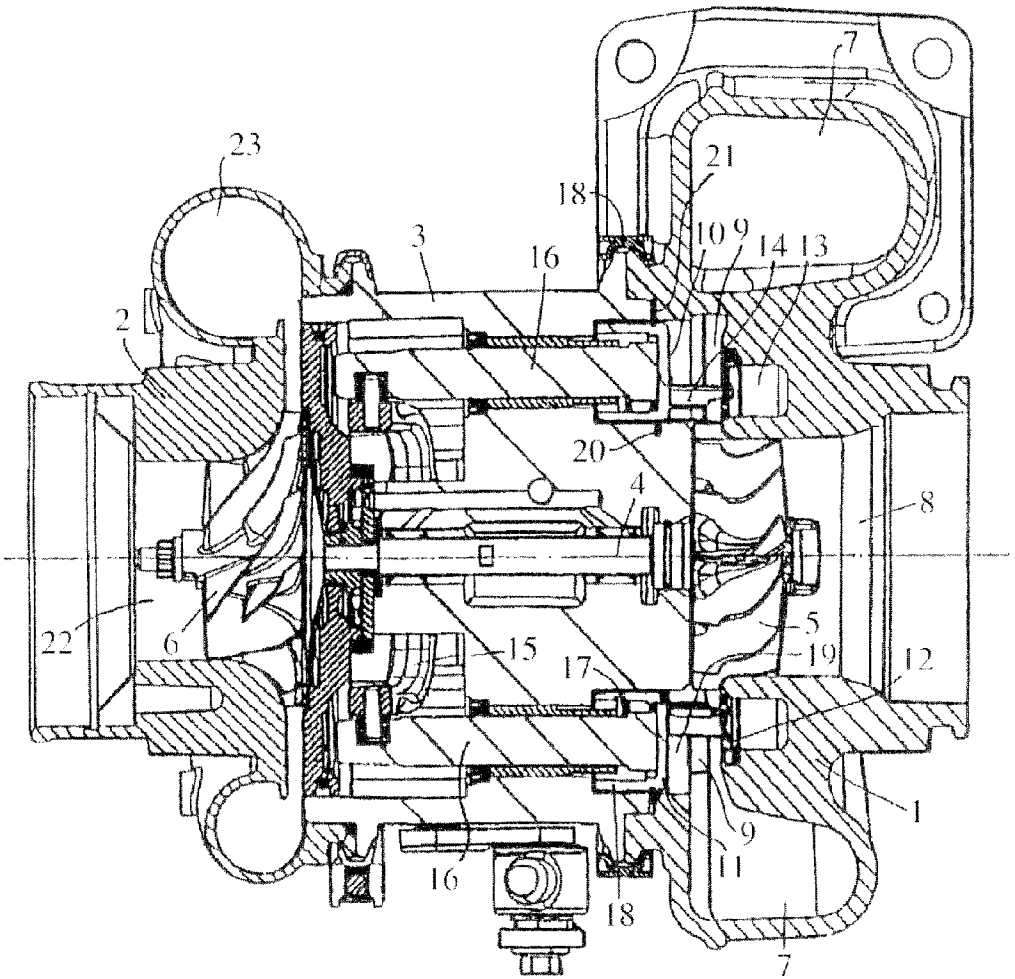
FIG. 1 is an axial cross-section through a known variable geometry turbocharger.
Figure 3:
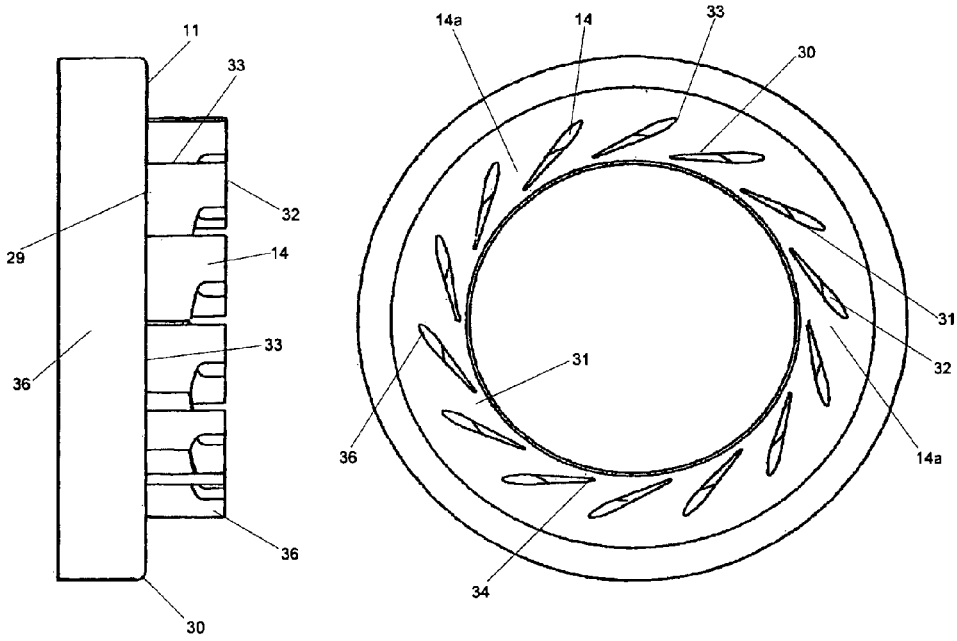
Figure 4A:
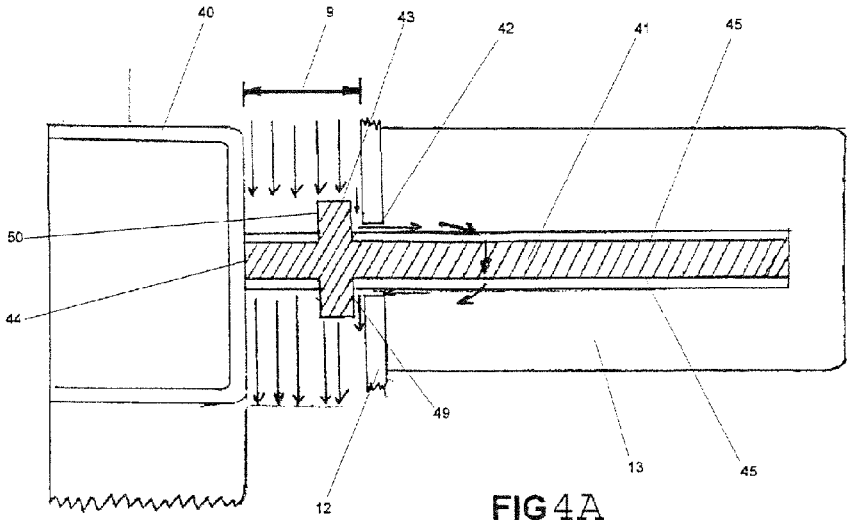
Figure 4B:
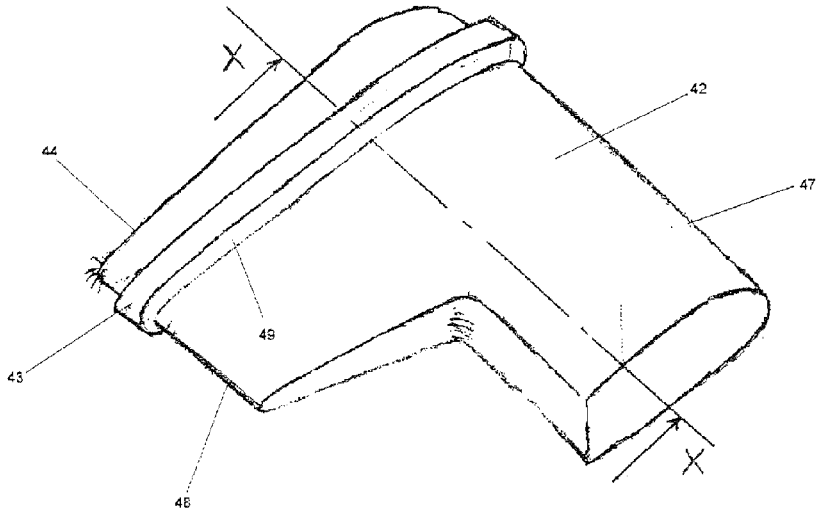
Figure 5:
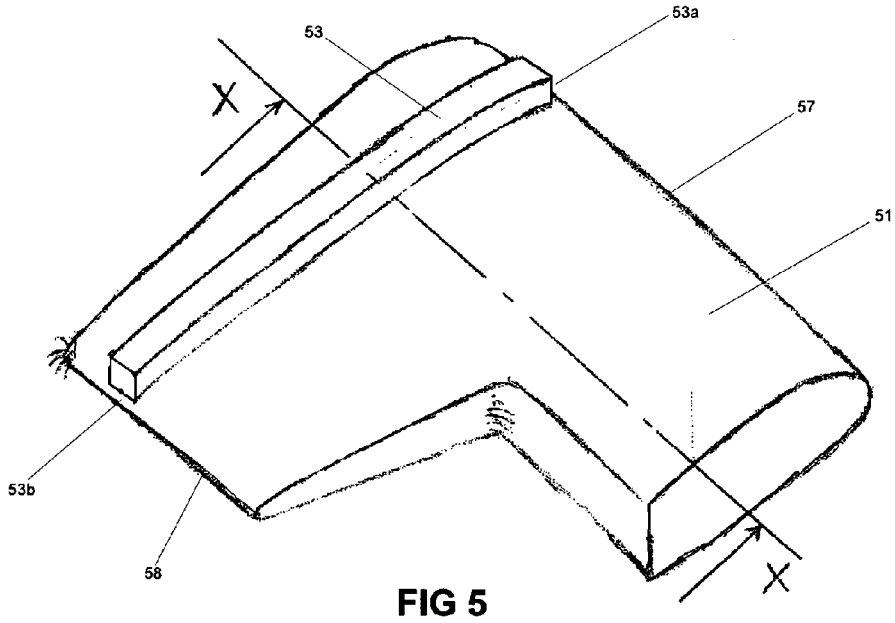
Figure 6:
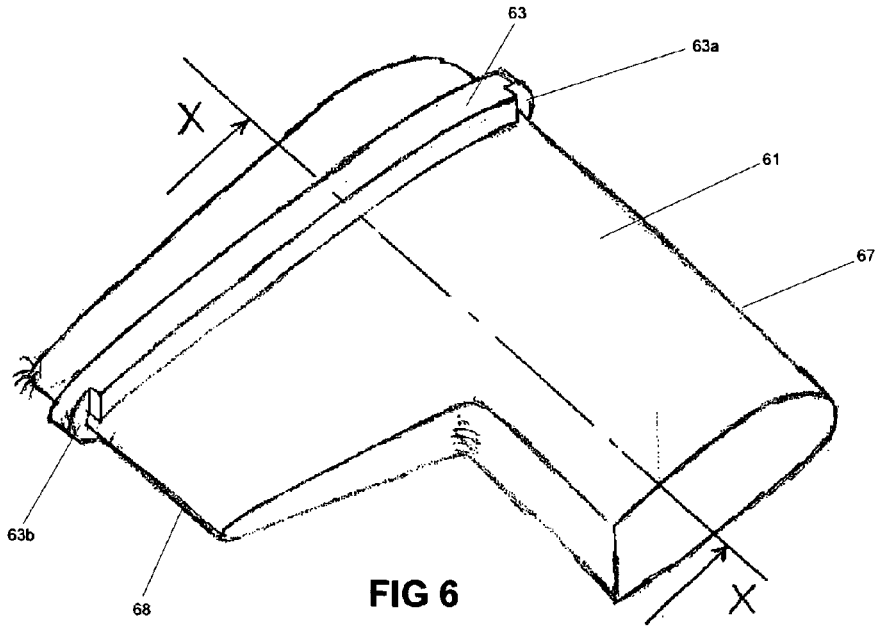
Figure 7A:
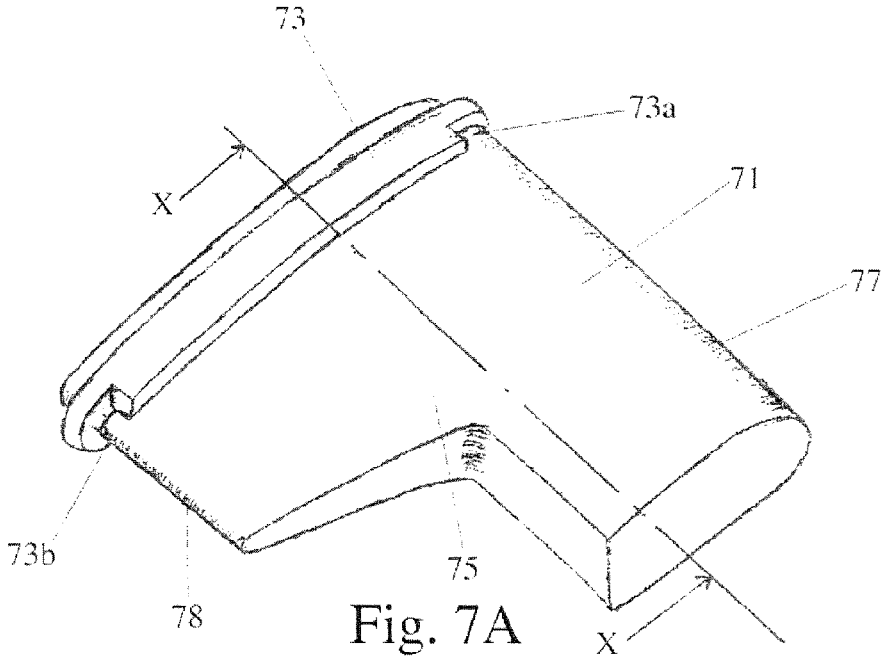
Figure 7B:
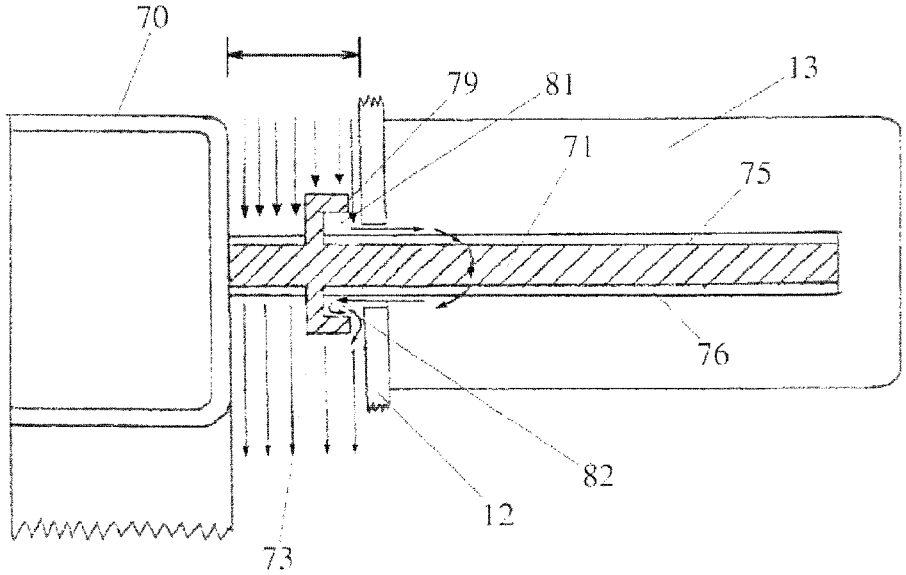

FIG. 3 schematically illustrates a known nozzle ring as included in the turbocharger of FIG. 1;

FIG. 4A illustrates a cross-section through the inlet structure of a variable geometry turbine according to the present invention;

FIG. 4B illustrates a nozzle ring vane of the turbine inlet of FIG. 4A;

FIGS. 5 and 6 illustrate alternative vane configuration in accordance with the present invention; and FIGS. 7A and 7B illustrate a modification of the embodiment of the invention illustrated in FIGS. 4A and 4B.

Referring to FIG. 1, this illustrates a known variable geometry turbocharger comprises a variable geometry turbine housing 1 and a compressor housing 2 interconnected by a central bearing housing 3. A turbocharger shaft 4 extends from the turbine housing 1 to the compressor housing 2 through the bearing housing 3. A turbine wheel 5 is mounted on one end of the shaft 4 for rotation within the turbine housing 1, and a compressor wheel 6 is mounted on the other end of the shaft 4 for rotation within the compressor housing 2. The shaft 4 rotates about turbocharger axis 4*a* on bearing assemblies located in the bearing housing.

The turbine housing 1 defines an inlet chamber 7 (typically a volute) to which gas from an internal combustion engine (not shown) is delivered. The exhaust gas flows from the inlet chamber 7 to an axial outlet passageway 8 via an annular inlet passageway 9 and turbine wheel 5. The inlet passageway 9 is defined on one side by the face 10 of a radial wall of a movable annular wall member 11, commonly referred to as a "nozzle ring", and on the opposite side by an annular shroud 12 which forms the wall of the inlet passageway 9 facing the nozzle ring 11. The shroud 12 covers the opening of an annular recess 13 in the turbine housing 1.

The nozzle ring 11 supports an array of circumferentially and equally spaced inlet vanes 14 each of which extends across the inlet passageway 9. Vane passages 14*a* are defined between adjacent vanes 14. The vanes 14 are orientated to deflect gas flowing through the vane passages 14*a* towards the direction of rotation of the turbine wheel 5. When the nozzle ring 11 is proximate to the annular shroud 12, the vanes 14 project through suitably configured vane slots in the shroud 12, into the recess 13.

An actuator (not shown) is operable to control the position of the nozzle ring 11 via an actuator output shaft (not shown), which is linked to a stirrup member 15. The stirrup member 15 in turn engages axially extending guide rods 16 that support the nozzle ring 11. Accordingly, by appropriate control of the actuator (which may be of any known type such as for instance pneumatic or electric), the axial position of the guide rods 16 and thus of the nozzle ring 11 can be controlled. It will be appreciated that details of the nozzle ring mounting and guide arrangements may differ from those illustrated.

The nozzle ring 11 has axially extending radially inner and outer annular flanges 17 and 18 that extend into an annular cavity 19 provided in the turbine housing 1. Inner and outer sealing rings 20 and 21 are provided to seal the nozzle ring 11 with respect to inner and outer annular surfaces of the annular cavity 19 respectively, whilst allowing the nozzle ring 11 to slide within the annular cavity 19. The inner sealing ring 20 is supported within an annular groove formed in the radially inner annular surface of the cavity 19 and bears against the inner annular flange 17 of the nozzle ring 11. The outer sealing ring 20 is supported within an annular groove formed in the radially outer annular surface of the cavity 19 and bears against the outer annular flange 18 of the nozzle ring 11. It will be appreciated that the inner and/or outer sealing rings could be mounted in a respective annular groove in the nozzle ring flanges rather than as shown (See for instance FIG. 2*a*).

Exhaust gas flowing from the inlet chamber 7 to the outlet passageway 8 passes over the turbine wheel 5 and as a result torque is applied to the shaft 4 to drive the compressor wheel 6. Rotation of the compressor wheel 6 within the compressor housing 2 pressurises ambient air present in an air inlet 22 and delivers the pressurised air to an air outlet volute 23 from which it is fed to an internal combustion engine (not shown). The speed of the turbine wheel 5 is dependent upon the velocity of the gas passing through the annular inlet passageway 9. For a fixed rate of mass of gas flowing into the inlet passageway, the gas velocity is a function of the width of the inlet passageway 9, the width being adjustable by controlling the axial position of the nozzle ring 11. As the width of the inlet passageway 9 is reduced, the velocity of the gas passing through it increases. FIG. 1 shows the annular inlet passageway 9 fully open. The inlet passageway 9 may be closed to a minimum appropriate to different operating modes by moving the face 10 of the nozzle ring 11 towards the shroud 12.

Figure 2A:
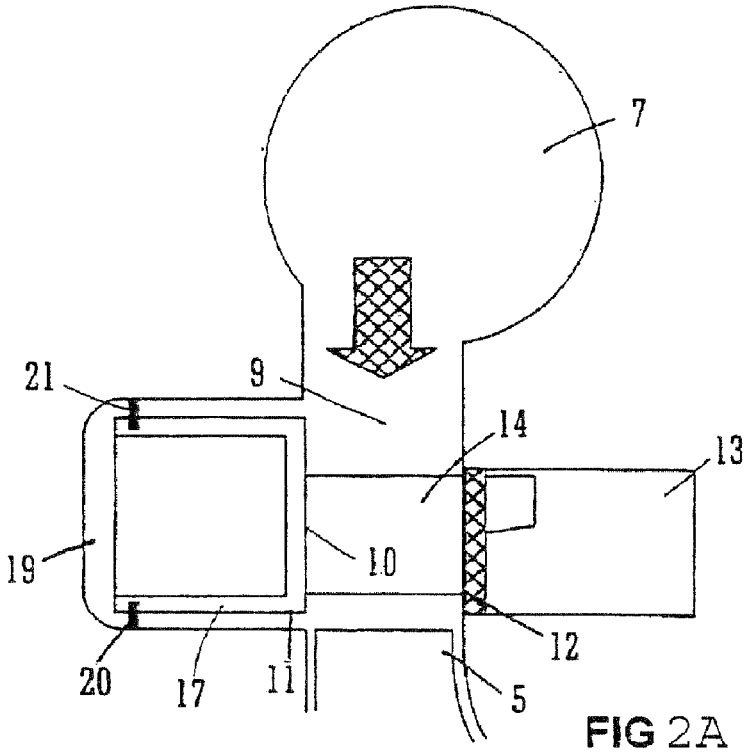
FIGS. 2A and 2B are cross-sections through part of a variable geometry turbine inlet schematically illustrating the inlet structure of the turbine of FIG. 1.
Figure 2B:
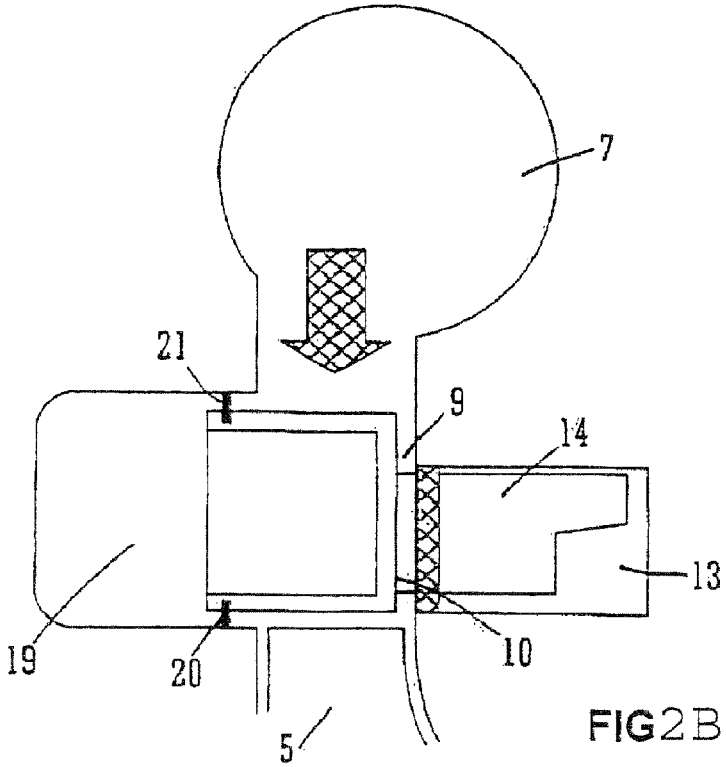

Referring now to FIGS. 2*a* and 2*b*, these are schematic cross-sections through part of a variable geometry turbine inlet of the general type shown in FIG. 1. Accordingly, like reference numerals are used where appropriate. The views are cross-sectional views corresponding to the cross-sectional views shown in FIG. 1, and show a nozzle ring 11 supporting vanes 14 which extend across an annular inlet passage 9 between a turbine inlet chamber 7 and turbine wheel 5. The nozzle ring 11 is axially slideable within a nozzle ring cavity 19. Radially inner and outer annular flanges 17 and 18 of the nozzle ring 11 are sealed with respect to the cavity 19 by annular seal members 20 and 21 which in this example are located in grooves provided in the respective flanges 17, 18 rather than grooves formed in the cavity walls. The inlet passageway 9 is defined on one side by the face 10 of the nozzle ring 11 and on the other by a shroud 12. The shroud 12 is provided with vane slots (not visible in these figures) which allow the vanes 14 to pass through the shroud 12 into a recess 13 in order to accommodate axial movement of the nozzle ring 12 to vary the inlet width between the face of the nozzle ring 10 and the shroud 12.

In FIG. 2*a* the nozzle ring is shown in an "open" position so that the width of the inlet passageway 9 defined between the nozzle ring face 10 and the shroud 12 is relatively large. The position shown is not necessarily the 'fully' open position, as in some turbochargers it may be possible to withdraw the nozzle ring 11 further into the nozzle ring cavity 19 (as for instance illustrated in FIG. 1).

In FIG. 2*b* the nozzle ring 11 is shown in a "closed" position in which the face 10 of the nozzle ring 11 is moved close to the shroud 12 to reduce the width of the inlet passageway 9 towards a minimum. At the "minimum" opening the nozzle ring 11 may be spaced from the shroud 12 as illustrated, or may contact the shroud 12.

FIGS. 3*a* and 3*b* are front and side views respectively of a nozzle ring 11 of the type shown in FIG. 1 and illustrated schematically in FIGS. 2*a* and 2*b*. The vanes 14 are joined to the nozzle ring at a "root" 29 and define first and second major surfaces 30, 31 (best viewed in FIG. 3*a*) that extend in a first generally axial direction between the root 29 and an axially distal tip 32. The axial length of each vane 14 is referred to as its height, whereas the vane width, or chord length, is the distance between leading and trailing edges 33, 34 relative to the radial flow of the exhaust gas passing through the inlet passageway 9. The major surfaces 30,31 extend between the leading and trailing edges 33, 34 and are generally smooth and continuous. The first major surface 30 faces generally upstream towards the incoming gas and is sometimes referred to as the pressure face, whereas the second major surface 31 faces in the opposite downstream direction and is sometimes referred to as the suction face. The vane passages 14*a* are defined between the high and low pressure faces of adjacent vanes.

Each vane 14 is cut away to define a nose portion 36 of reduced width. This particular configuration is provided to reduce the chord length of the each vane that is exposed to the exhaust gas flow when the nozzle ring 11 is opened into an "over open" position as mentioned above. It will, however, be appreciated that the vanes 14 need not necessarily have this cut away configuration.

Although the vanes 14 and vane slots provided in the shroud 12 may be sized so that the vanes are a close fit within the slots, a small gap will nevertheless exist between the two which provides a leakage flow path through the shroud cavity 13. Whilst at relatively large inlet widths any leakage flow will make up only a small proportion of the total flow through the turbine, at relatively small inlet widths such leakage flow becomes more significant. In addition, at relatively small inlet widths, the pressure differential between the low pressure face 30 and high pressure face 31 of each vane 14 increases which will tend to drive more leakage flow through the leakage path increasing the resultant loss in efficiency.

FIGS. 4*a* and 4*b* illustrate a first embodiment of the present invention which addresses the above problem. FIG. 4*a* is a perspective view of a vane modified in accordance with the present invention and FIG. 4*b* is a schematic illustration of a turbine inlet structure including a nozzle ring provided with vanes according to FIG. 3*a*.

In more detail, the nozzle ring 40 according to the present invention supports an annular array of vanes 41 extending across a turbine inlet passageway 9 and into a shroud cavity 13 through vane slots 42 defined in a shroud plate 12. As such, the nozzle ring and turbine inlet structure is substantially the same as that shown in FIGS. 1 and 2. However, in accordance with the present invention the vanes 41 are each provided with a rib 43 which circumscribes the vane a relatively short distance away from its root 44. The rib 43 thus extends across both the high pressure and low pressure vane surfaces 45 and 46 from the leading edge 47 to the trailing edge 48. The rib 43 has a width, measured in the axial direction of the turbine, extending between a first axially facing rib surface 49 and a second axially facing rib surface 50. The first axially facing rib surface 49 faces toward the shroud plate 12 and the second axially facing rib surface 50 faces toward the nozzle ring 40.

The rib 43 is positioned on the vane 41 so that as the nozzle ring approaches a position corresponding to the minimum turbine inlet width the rib surface 49 will come into close proximity to the shroud plate 12. The width of the rib 43 is such that the axial distance between the rib surface 50 and the face of the nozzle ring 40 is greater than the width of the rib 43 so that the rib 43 has little impact on the vane profile presented to the inlet exhaust gas flow even when the turbine inlet width 9 approaches a minimum width.

FIG. 4*a* shows the nozzle ring moved to a position in which the width of the inlet 9 is approaching a minimum and as such illustrates how the rib 43 inhibits gas flow entering the shroud cavity 13 at the upstream pressure face 45 of each vane 41 through the respective vane slot 42. Similarly, FIG. 4*a* illustrates how the rib 43 inhibits exhaust gas flow from the shroud cavity 13 into the turbine inlet 9 downstream of end vane 41 through the vane slot 42 adjacent the downstream suction surface 46 of the vane. Moreover, the surface 49 of the rib 43 prevents any leakage gas flow which may flow through the cavity 13 from travelling in an axial direction, but rather turns that exhaust gas flow in a generally radial direction. Accordingly, any exhaust gas flow which does leak through the shroud cavity 13 will mix with the main exhaust gas flow through the turbine inlet 9 with much less turbulence than it would if flowing in a purely axial direction. The overall effect is to reduce both the level of leakage flow bypassing the vane passages and to smooth mixing between any leakage gas flow that does flow and the main inlet gas flow (downstream of the vanes). This greatly reduces any efficiency losses which may otherwise become significant at small turbine inlet widths due to the leakage flow through the cavity 13.

The nozzle ring 40 may be operated so that at the minimum width of the inlet 9, the surface 49 of the rib 43 contacts shroud plate 12. It will be appreciated that in such a position the rib 43 will substantially seal the vane slots 42 further reducing, or entirely preventing, leakage flow through the shroud cavity 13. The relatively narrow width of the rib 43 compared to the width of the inlet 9, even at minimum width, minimises any otherwise adverse effect the presence of the rib may have on the exhaust gas flowing through the vane passages, even at minimum inlet width.

FIGS. 4 and 5 illustrates a variation of the vane 41 in accordance with the second embodiment of the present invention. A modified vane 51 corresponds to the vane 41 except that although the rib 53 extends on both pressure and suction surfaces of the vane (only the pressure surface is visible in the figures), it is discontinuous in that there is a gap 53*a* in the rib 53 at the upstream edge 57 of the vane and a gap 53*b* in the rib 53 at the downstream edge 58 of the vane. The gaps 53*a* and 53*b* prevent the rib 53 from completely sealing the vane slot 42 even if the surface 59 of the rib contacts the shroud plate 12 when the turbine inlet 9 is closed to a minimum width. That is, a small leakage flow will be permitted to flow through the shroud cavity 13 via the gaps 53*a* and 53*b* which expose portions of the vane slots 42. There may be some embodiments of the invention in which maintaining a minimum leakage flow even with the nozzle ring fully closed is desirable in order to trim the efficiency of the turbine at minimum inlet widths.

FIG. 6 illustrates a variation of the embodiment of the invention shown in FIG. 5. Here, the rib 63 of modified vane 61 continuously circumscribes the vane, but has reduced width portions 63*a* and 63*b* adjacent the upstream and downstream vane edges 67 and 68 respectively. The reduced width portions 63*a* and 63*b* are defined by respective recesses formed in the face 69 of the rib so that if the rib 63 contacts the shroud plate 12 when the inlet width is closed to a minimum, there will remain small gaps between the rib 63 and the shroud plate exposing the vane slots at the upstream and downstream vane edges 67, 68 which will allow a minimum exhaust gas leakage flow through the shroud cavity 13 in essentially the same manner as described above in relation to FIG. 5.

FIG. 7*a* illustrates a further embodiment of the invention which is a modification of the vane 61 illustrated in FIG. 5. The modified vane 71 has a rib 73 broadly corresponding to the rib 63 of rib 63, but which is provided with an undercut in the shroud facing rib surface 79 extending along both the pressure face 75 and suction face 76 of the vane 71. The undercut defines a channel 81 running along the rib 73 at the pressure surface 75 of the vane, and a similar channel 82 running along the rib at the suction surface 76 of the vane between recesses 73*a* and 73*b* defined in the rib 73 at the upstream and downstream vane edges 77 and 78 (similar to the reduced width portions 63*a* and 63*b* of the rib 63 illustrated in FIG. 5).

FIG. 7*b* is a schematic illustration of a turbine inlet including vanes 71 of FIG. 7*a*, but otherwise corresponding to FIG. 4*b* described above. In FIG. 7*b* the nozzle ring 70 is closed towards a minimum position at which the rib 73 approaches contact with the shroud plate 12. Any leakage gas flow which passes between the rib 73 and the shroud plate 12 at the upstream pressure surface 75 of the vane 71 and into the shroud cavity 13 will tend to flow along the rib channel 82 when it leaves the shroud cavity 13 at the downstream suction surface of the vane. The leakage exhaust gas flow will thus be turned in a generally tangential direction as it flows along the rib channel 82 before joining the main exhaust gas flow through the turbine inlet 9 at the downstream vane edge 78 in the region of the recess 73*b*. If the inlet passage 9 is closed further, so that the rib 73 contacts the shroud plate 12, a minimum leakage flow will still be permitted through the cavity 13 via the recesses 83*a* and 83*b* and the rib channels 81 and 82. Thus, again, any leakage flow exiting the shroud cavity 13 at the suction surface 76 of the vane 71 will be directed in a generally tangential direction.

Accordingly, smooth mixing of the leakage flow with the main exhaust gas flow is further improved as the leakage flow is directed in substantially the same direction as the main exhaust gas flow which is turned in a generally tangential direction by the vanes 71.

It will be appreciated that rather than providing the rib 73 with reduced width portions defined by the recesses 73*a* and 73*b*, the vane rib 73 could be discontinuous at the upstream and downstream edges of the vane 77, 78 similar to the rib 53 illustrated in FIG. 5. However, providing the rib 73 with a reduced width portion at the upstream and downstream edges of the vane helps to direct the leakage flow in the preferred tangential direction.

The present invention therefore provides a vane structure which allows for tailoring, reduction, or even substantial or complete elimination of any leakage flow through the shroud cavity when the nozzle is closed to a minimum position. Furthermore, the present invention enables any leakage flow (i.e. flow through the shroud cavity) to be directed in either a radial or generally tangential direction to reduce energy losses when mixing with the main exhaust gas flow.

A further advantage of the present invention in embodiments in which the vane rib contacts the shroud plate at minimum inlet width is that the rib provides a "hard stop" which accurately positions the nozzle ring at minimum width. This can be an advantage in some embodiments because it can be difficult to precisely control the position of the nozzle ring at small inlet widths at which pressure on the face of the nozzle ring can drop sharply due to the increased speed of exhaust gas flow through the inlet.

As mentioned above, the precise configuration of the vane, such as the provision or otherwise of the cut-away defining the reduced width nose portion, can vary from that illustrated. In addition, details of the rib provided on the vane may vary from the particular embodiments illustrated. For instance, in some embodiments it may be sufficient to have a rib defined on the upstream pressure surface only of the vane to inhibit exhaust gas flow into the shroud cavity. As another variation of the illustrated embodiments, the vane 71 could be modified to include an undercut in the rib 73 at the downstream surface 76 only of the vane 71 so that any leakage flow flowing into the shroud cavity 13 via the rib recess 73*a* is turned in a tangential direction as it exits the shroud cavity 13 at the suction surface 76 of the vane via recess 73*b*.

Other possible modifications of the embodiments of the invention described above would be readily apparent to the appropriately skilled person.

The invention claimed is:

1. A variable geometry turbine comprising:

a turbine wheel supported in a housing for rotation about a turbine axis;

an annular inlet passage defined between first and second radial inlet surfaces, one of said first and second inlet surfaces being defined by a moveable wall member and the other of said first and second inlet surfaces being defined by a facing wall of said housing, the moveable wall member being moveable relative to the facing wall of the housing along the turbine axis to vary the size of the inlet passageway;

a substantially annular array of vanes extending across the inlet passageway;

each vane being fixed to said first inlet surface, the second inlet surface being provided with respective vane slots for receiving each vane to accommodate relative movement between the first and second surfaces;

wherein each vane has first and second major vane surfaces having a chordal length extending between a radially outer leading vane edge and a radially inner trailing vane edge, the first major vane surface facing generally away from the axis and the second major vane surface facing generally towards the axis, such that vane passages are defined between the first major surface of each vane and the second major surface of an adjacent vane in the array; and wherein a rib extends across at least a substantial portion of the chordal length of at least one of the first and second major vane surfaces of one or more vanes of the array.

2. A variable geometry turbine according to claim 1, wherein the rib extends parallel to, and is spaced from, said first inlet surface.

3. A variable geometry turbine according to claim 1, wherein the rib extends parallel to the second inlet surface.

4. A variable geometry turbine according to claim 1, wherein a clearance gap is defined between said at least one major vane surface and a respective vane slot when the vane extends through said slot, the clearance gap having a width defined between the vane surface and an edge of the slot, the rib defining an elongate surface facing the second inlet surface and extending to a height above said at least one major vane surface, said height being greater than the width of the clearance gap.

5. A variable geometry turbine according to claim 4, wherein said surface of the rib lies in a plane parallel to a plane containing said second surface.

6. A variable geometry turbine according to claim 4, wherein said rib circumscribes the vane and so extends across both the first and second major surfaces.

7. A variable geometry turbine according to claim 6, wherein a recess is provided in said surface of the rib in the region of the leading and/or trailing edge of the vane so that said surface is discontinuous at the leading and/or trailing edge of the vane.

8. A variable geometry turbine according to claim 7, wherein the or each recess extends around the trailing and/or leading edge of the vane respectively from the first to the second major vane surface.

9. A variable geometry turbine according to claim 6, wherein a gap is provided in said rib in the region of the leading and/or trailing vane edge so that the rib is discontinuous at the leading and/or trailing edge of the vane.

10. A variable geometry turbine according to claim 9, wherein the or each gap extends around the trailing and/or leading edge of the vane respectively, from the first to the second major vane surface.

11. A variable geometry turbine according to claim 4, wherein an elongate channel is formed in said surface of the rib extending between said upstream and downstream vane edges across the second major vane surface.

12. A variable geometry turbine according to claim 11, in which a recess is provided in the rib surface, or a gap is provided in the rib, in the region of the leading and/or trailing edge of the vane so that the rib surface is discontinuous at the leading or trailing edge of the vane, wherein the or each channel extends to the or each or gap.

13. A variable geometry turbine according to claim 12, wherein the or each recess or gap extends around the trailing and/or leading edge of the vane respectively, from the first to the second major vane surface.

14. A variable geometry turbine according to claim 4, wherein an elongate channel is formed in said surface of the rib extending between said upstream and downstream vane edges across the first major vane surface.

15. A variable geometry turbine according to claim 1, wherein the rib has a width in a direction parallel to the turbine axis, and wherein said rib is spaced from said first surface by an axial distance greater than said width.

16. A variable geometry turbine according to claim 15, wherein the width of the rib is greater than the height to which the rib extends above the major vane surface.

* * * * *